US007661472B2

(12) United States Patent
van Batenburg et al.

(10) Patent No.: US 7,661,472 B2
(45) Date of Patent: Feb. 16, 2010

(54) METHODS AND APPARATUS FOR INJECTING FLUIDS AT A SUBTERRANEAN LOCATION IN A WELL

(75) Inventors: Diederik van Batenburg, Delft (NL); Verlaan Marco, Rotterdam (NL)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 12/331,031

(22) Filed: Dec. 9, 2008

(65) Prior Publication Data

US 2009/0107665 A1 Apr. 30, 2009

Related U.S. Application Data

(62) Division of application No. 11/586,384, filed on Oct. 25, 2006, now Pat. No. 7,484,565.

(51) Int. Cl.
*E21B 33/124* (2006.01)

(52) U.S. Cl. ..... 166/191; 166/387

(58) Field of Classification Search ..... 166/180, 166/191, 263, 268, 285, 305.1, 311, 387
See application file for complete search history.

(56) References Cited

U.S. PATENT DOCUMENTS

| | | | | |
|---|---|---|---|---|
| 3,294,168 | A * | 12/1966 | Cornelis et al. | 166/295 |
| 3,349,849 | A * | 10/1967 | Closmann | 166/285 |
| 3,386,508 | A * | 6/1968 | Bielstein et al. | 166/272.3 |
| 2002/0033261 | A1 * | 3/2002 | Metcalfe | 166/285 |
| 2003/0131997 | A1 * | 7/2003 | Chatterji et al. | 166/278 |
| 2004/0055758 | A1 * | 3/2004 | Brezinski et al. | 166/384 |
| 2005/0056425 | A1 * | 3/2005 | Grigsby et al. | 166/296 |
| 2005/0103504 | A1 * | 5/2005 | Szarka | 166/386 |
| 2006/0000617 | A1 * | 1/2006 | Harrall et al. | 166/380 |

FOREIGN PATENT DOCUMENTS

WO WO 2005088064 A1 * 9/2005

* cited by examiner

*Primary Examiner*—Daniel P Stephenson
(74) *Attorney, Agent, or Firm*—Robert A. Kent; Booth Albanesi Schroeder LLC

(57) ABSTRACT

Disclosed are retrievable through-tubing tools and methods for use in wellbores to inject fluids at subterranean locations wherein the tools have spaced foamed seal elements that are retracted during installation and expand when in use.

22 Claims, 2 Drawing Sheets

METHODS AND APPARATUS FOR INJECTING FLUIDS AT A SUBTERRANEAN LOCATION IN A WELL

CROSS-REFERENCE TO RELATED APPLICATIONS

This application is a divisional of U.S. patent application Ser. No. 11/586,384, filed on Oct. 25, 2006 now U.S. Pat. No. 7,484,565.

STATEMENT REGARDING FEDERALLY SPONSORED RESEARCH OR DEVELOPMENT

None

REFERENCE TO MICROFICHE APPENDIX

Not applicable

TECHNICAL FIELD

The present inventions relate generally to well production operations and more particularly to the injection of fluids at subterranean locations in wells.

BACKGROUND OF THE INVENTIONS

An increasing number of wells have been completed with the installation of liners, perforated or slotted liners, screens, and/or gravel packing. These configurations are typically connected to smaller-diameter production tubing extending to the surface. For example, an installation having a 7-inch liner or base pipe of a screen could be connected to 3½ inch production tubing or and installation where an expandable screen or base pipe has been installed and expanded.

Maintaining and completing these installations can require a variety of localized processes, for example, acid washes for screens and gravel packs, water shut-off water polymer injection through perforations, screens and gravel packs, open hole and through casing perforation stimulation. The efficiency of these processes is dependent on the proper placement and direction of the treating fluids.

The smaller production tubing limits the size and type of tools and equipment available to service these configurations. Tools generally available from oil tool suppliers called "through-tubing" tools are used to perform these processes. Tools that comprise an injection port located between spaced seal elements to isolate a well section are called Selective Injection Packers. Selective Injection Packers utilize cups or inflatable seal elements that are designed to run through production tubing and isolate a portion of the well to allow precise injection of treatment chemical. While these tools are being used currently, they present isolation and retrieving problems.

Tools with cup-type seal elements have size limitation, and tools with inflatable seal elements must be successfully inflated, utilized and then deflated before moving to a different location. Once inflated, the tool cannot slide longitudinally along the wellbore and, thus, cannot inject fluids while they are being moved. When settable fluids are being injected, the time consumed with inflation-deflation between injections can result in failures. In addition, these inflatable seal tools suffer from the inherent risk of the failure to inflate or deflate.

Thus, there are needs for methods and apparatuses for performing through-tubing isolated injection of treatment fluids into materials in and surrounding wellbores.

SUMMARY OF THE INVENTIONS

The present inventions provide improved through-tubing well treatment methods and apparatuses for performing isolated fluid injection.

More specifically, the present inventions are directed to a through-tubing tool with an improved expandable seal configuration.

In another aspect, the present inventions are directed to an improved selective injection packer with seal elements made from closed-cell foam material that is compressed during movement through the tubing and is unrestrained to expand in the wellbore to provide an effective seal.

In a further aspect, the present inventions are directed to an improved selective injection packer having a mandrel, at least one injection port in the mandrel, and spaced seal elements on the mandrel wherein the seal elements comprise foamed cell elastomer.

A more complete understanding of the present inventions and the advantages thereof may be acquired by referring to the following description taken in conjunction with the accompanying drawings in which:

DETAILED DESCRIPTION

The present inventions provide improved methods and apparatuses for injecting fluids at subterranean locations and has particular advantages when used in through-tubing environments. The methods and apparatuses can be used in either vertical or horizontal wellbores, in consolidated and unconsolidated formations, in "open-hole" and/or under reamed completions, as well as in cased wells. If used in a cased wellbore, the casing is perforated to provide for fluid communication with the wellbore. The term "vertical wellbore" is used herein to mean the portion of a wellbore to be completed which is substantially vertical or deviated from vertical in an amount up to about 15°. The term "horizontal wellbore" is used herein to mean the portion of a wellbore to be completed is substantially horizontal, or at an angle from vertical, in the range of from about 75° to about 105°. Since the present inventions are applicable in horizontal and inclined wellbores, the terms "upper and lower" and "top and bottom" as used herein are relative terms and are intended to apply to the respective positions within a particular wellbore, while the term "levels" is meant to refer to respective spaced positions along the wellbore.

Figure 1:
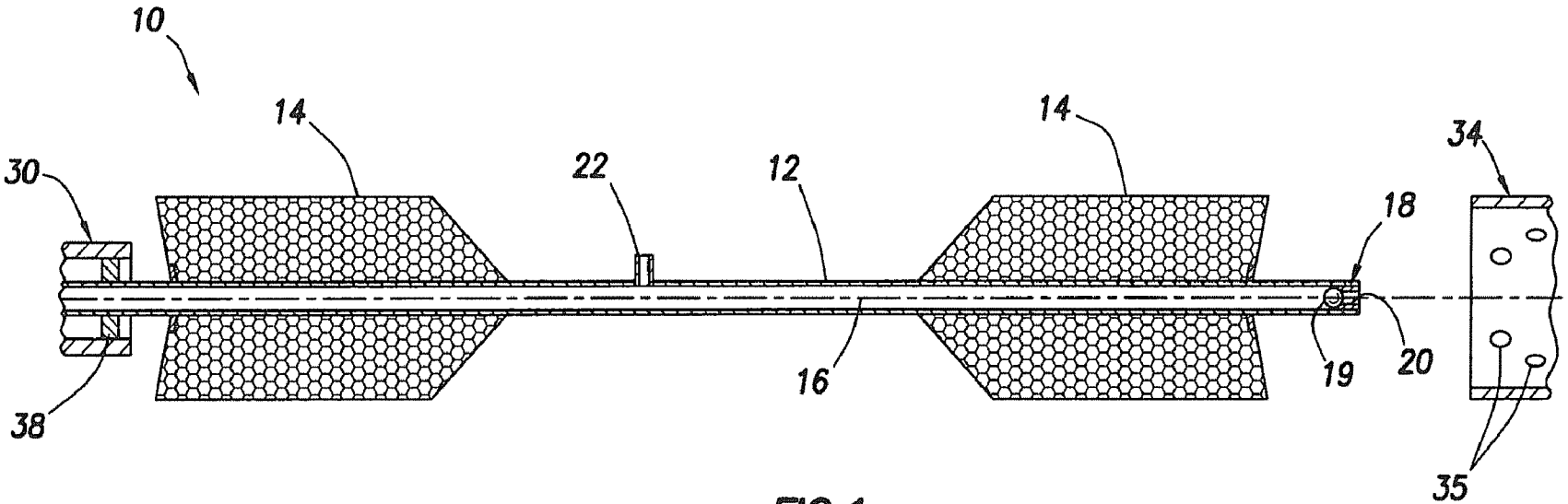
FIG. 1 is a cross section of one embodiment of the improved apparatus of the present inventions illustrated in the run configuration.
Figure 2:
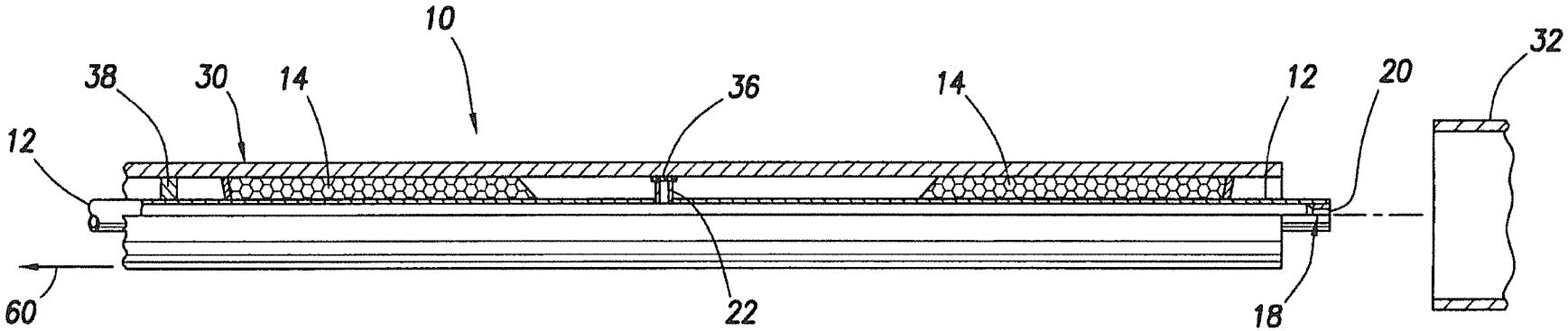
FIG. 2 is a partial cross-section view of the FIG. 1 embodiment of the improved apparatus of the present inventions illustrated in the expanded configuration.
Figure 3:
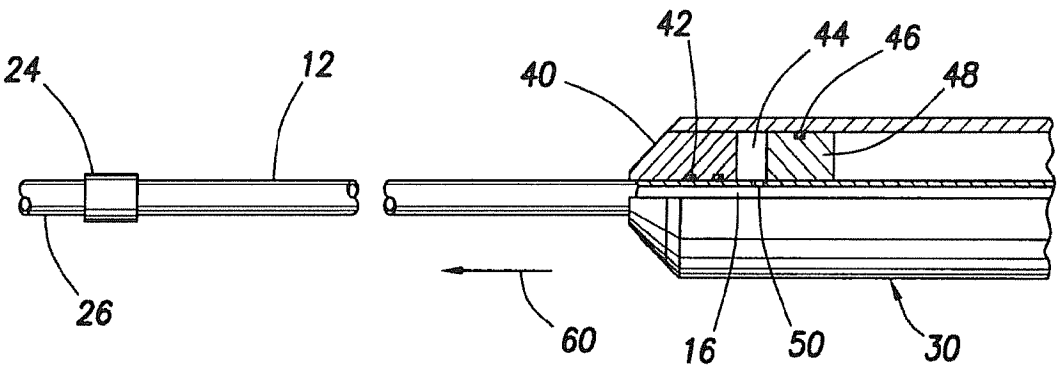
FIG. 3 is a partial cross-section view of the actuator portion of the FIG. 1 embodiment of the improved apparatus of the present inventions.

Referring more particularly to the drawings, wherein like reference characters are used throughout the various figures to refer to like or corresponding parts, there is shown in FIGS. 1-3 one embodiment of an injection tool assembly 10 in accordance with the present inventions. The tool assembly 10 has the capacity to be lowered into a wellbore and pass through restricted diameter production tubing 32 (see FIG. 2) to access and inject fluids into a larger-diameter wellbore tubular 34 (see FIG. 1), such as, liner (illustrated as having perforations 35) or perforated screen base pipe. Tools like tool assembly 10 with the capacity to move through smaller tubing and operate in a larger-diameter wellbore portion are referred to as "through-tubing" tools.

The assembly comprises a mandrel body 12 on which is mounted upper and lower seal elements 14. To provide through-tubing capacity, the seal elements are compressed and restrained in a size to fit through the restricted tubing and are released to expand to a size to function in the larger-diameter injection location. The tool is removed by forcing the seal elements through the restricted tubing without first compressing them.

In FIG. 1, the seal elements 14 are shown in the fully-expanded position. In this exemplary embodiment of the present inventions, the seal elements 14 are made from a open-cell flexible foam material. The foam material is selected to form a seal element to have sufficient compressibility to pass through the restricted tubing and sufficient strength to function to restrict fluid flow around the tool.

Foams and foam materials are commercially available with a variety of properties. Foams are made from low-density elastomers, plastics, and other materials with various porosities. They are used in a variety of applications. Open-cellular foams comprise material that substantially has interconnected pores or cells. Closed-cellular foams do not have substantial amounts of interconnected pores or cells. Flexible foams can compress, bend, flex or absorb impacts without cracking or delaminating. Rigid foams feature a matrix with very little or no flexibility.

Important specifications to consider for selecting foams and foam materials for use in forming seal elements include tensile strength, tensile modulus, elongation, tear strength, use temperature, thermal conductivity, and compressibility. According to an exemplary embodiment of the present inventions, the seal elements could be made at least in part from any open-cell flexible foam having a sufficient compressibility, density, firmness, and resilience suitable for the desired application. One of ordinary skill in the art with the benefit of this disclosure will be able to determine the appropriate foam material for the seal elements.

The foam seal elements should be sized to properly engage the inner wall of the largest-diameter tubular in which the tool of the present inventions is to operate and of sufficient length to restrict flow of treatment fluids along the tubular 34. The foam body should also readily compress to a size to pass through the smallest internal diameter restrictions leading to the treatment location.

In a further exemplary embodiment of the present inventions, a closed-cell foam material could be used in place of, or in combination with, open-cell foam material.

In certain exemplary embodiments of the present inventions, the seal elements will have a cylindrical shape. In certain exemplary embodiments, the seal elements will have a constant cross section; in other embodiments such as shown, the cross section will vary along the length. In certain exemplary embodiments, the outer surface of the seal elements will have a smooth outer surface; in others, the outer surface could be comprised of a plurality of one or more ribs of fins. In certain exemplary embodiments, the end faces of the seal elements will be planar, concave or convex.

The seal elements 14 are selected to have an expanded diameter and length to restrict flow along the annulus formed between the outside of the mandrel body 12 and the interior wall of a downhole tubular member such as a well liner. Preferably, the seal elements 14 contact the interior wall of the downhole tubular member at the treatment location and have sufficient length to prevent flow through the annulus.

An axially extending interior passageway 16 in the mandrel body 12 terminates at the downhole end at a valve seat 18 for receiving a ball valve 19 (shown installed). A passage 20 in the valve seat 18 communicates with the exterior of the mandrel. The opposite or upper end of the passageway 16 is in fluid communication with a tubing string extending to the wellhead. The mandrel body 12 is mechanically coupled by a collar 24 to a work string 26 (see FIG. 3). Typically, the work string 24 comprises coiled tubing, jointed tubing or the like and is used to insert the tool assembly 10 into a subterranean location in a wellbore. As used herein "work string" is used to refer to jointed or unjointed tubular members that are used to move, support and supply fluid to tools at subterranean locations in a well.

A port 22 located between the seal elements 14 is in fluid communication with the passageway 16. For simplicity of description, only one port is shown, and it is shown positioned at right angles to the body 12. It is to be understood that more than one port could be present and at other orientations.

In FIG. 2, the tool assembly 10 is illustrated in the run position with the outside diameter of seal elements 14 reduced (or compressed) so that it will pass through production tubing 32. In this run position, the seal elements 14 are compressed and retained inside a sleeve 30. The sleeve 30 is selected to have an outer diameter and length small enough to pass through the smallest internal diameter restrictions leading to the treatment location. The sleeve 30 is connected to an actuator assembly (not shown in FIG. 2) for removing the sleeve 30 from around the seal elements 14 when the tool assembly 10 reaches its treatment location. The sleeve 30 is supported from an annular guide 38 and carries a seal 36 that covers port 22 when in this run position. In this run position, the passageway 20 is open to flow both directions as no ball 19 is in place on seat 18.

An exemplary actuator assembly embodiment is illustrated in FIG. 3. A variable volume chamber 44 is formed inside the sleeve 30 around the body 12 and is bordered on one end by end cap 40 and the other by piston 48. End cap 40 is connected to the end of the sleeve 30 and surrounds and axially slides along the outside of body 12. Annular seals or packing 42 seals the annulus formed between the end cap 40 and body 12. Piston 48 is fixed on the outside of the body 12, and seals or packing 46 seals the annulus between piston 48 and the interior of sleeve 30. A port 50 connects chamber 44 and the interior passageway 16 of body 12. Shear pins not shown can be used to temporarily fix the sleeve 30 in the run position on the body 12.

In an alternative exemplary embodiment of the present inventions, the sleeve retaining the seal elements compressed could be made from a material that will dissolve when placed in the wellbore or when a particular fluid is pumped through the tool.

The tool assembly 10 may be used to perform the fluid injection methods of the present inventions at subterranean locations where access to the locations requires passage through a restriction. An example application of the methods of the inventions would be present when localized fluid injections are required at locations in a well screen located below a smaller-diameter production tubing 32. First, the tool 10 is assembled with seal elements 12 of a size to engage the walls of the well screen base pipe 34. The seal elements 12 are compressed and retained in the run position of FIG. 2 in a sleeve 30 of a diameter to pass through the production tubing 32.

The tool 10 is lowered into the well on coil tubing, a work string or the like and passed through the production tubing to the location of use in the larger base pipe 34 of the screen. A ball 19 is pumped down the work string 26 to close the seat 18. Continued pumping of fluid down the string 26 causes flow through port 50 and into chamber 44. Fluid entering chamber 44 causes end cap 40 and sleeve 30 to tend to axially move with respect to the body 12 in the direction of arrow 60 (see FIGS. 2 and 3). Continued pumping at a sufficient rate causes the sleeve 30 to move (severing any shear pins) to the position shown in FIG. 1 to uncover and release the seal elements 14. Seal elements 14 will expand into contact with the tubular member 34.

As treatment fluid is pumped through the port 22, the fluid will be localized to the perforations 35 in the base pipe 34 of the screen located between the seal elements 14. In addition fluid injections a can be performed at multiple locations by axially moving the tool 10. In addition, fluid can be injected continuously as the tool is moved.

To retrieve the tool 10 to the surface, the coil tubing is retracted by pulling the seal elements into and through the production tubing 32. The pliability of seal elements made from foamed material allows retrieval without requiring that the seal elements be compressed to a size smaller than the internal cross section of the production tubing 32.

In another example the tool 10 it run in the well and the seal elements are released inside a portion of an horizontally extending expanded screen (or expanded liner) installation. The well portion to be treated is subject to undesirable water incursion. Treatment fluid is pumped into (injected) into the screen portion to block water incursion. It is known that subterranean formation permeability and screen permeability can be altered by contacting the subterranean formation and or screen with a treating liquid containing one or more materials and thixotropy imparting agents. See for example the thixotropy imparting agents described in and described in the references cited in U.S. Pat. No. 6,823,939 issued Nov. 30, 2004 to Bouwmeester, et al. entitled Methods of Treating Subterranean Zones Penetrated by Well Bores. Suitable thixotropic fluids for water blocking can be selected from those known to persons of skill in the art in the industry. The treatment is performed by pumping a thixotropic fluid into and around the well screen and allowing the fluid to increase in viscosity. After treatment the tool is retrieved as described in the previous example.

Therefore, the present inventions are well adapted to carry out the objects and attain the ends and advantages mentioned as well as those which are inherent therein. While the invention has been depicted, described, and is defined by reference to exemplary embodiments of the inventions, such a reference does not imply a limitation on the inventions, and no such limitation is to be inferred. The inventions are capable of considerable modification, alteration, and equivalents in form and function, as will occur to those ordinarily skilled in the pertinent arts and having the benefit of this disclosure. The depicted and described embodiments of the inventions are exemplary only, and are not exhaustive of the scope of the inventions. Consequently, the inventions are intended to be limited only by the spirit and scope of the appended claims, giving full cognizance to equivalents in all respects.

What is claimed is:

1. An apparatus for use in injecting fluid at a subterranean wellbore location, the apparatus comprising:

(a) a body having an interior passageway connected to an injection port in the body;

(b) upper and lower annular seal elements mounted on the body, wherein:

(i) the seal elements are radially compressible, (ii) the seal elements being of a size to engage the walls of the wellbore at the injection location and wherein the seal elements are made at least in part from foamed material and are adapted for containing fluid in an annular space between the upper and lower seal elements; and (iii) the injection port is located between the seal elements;

(c) a sleeve surrounding and compressing the seal elements; and (d) an actuator assembly for axially moving the sleeve from around the seal elements when the apparatus reaches the injection location.

2. The injection apparatus of claim 1 wherein the foamed material is open celled foamed material.

3. The injection apparatus of claim 1 wherein foamed material is open celled foamed elastomeric material.

4. The injection apparatus of claim 1 wherein the seal elements have outer surfaces with cylindrical portions.

5. The injection apparatus of claim 1 wherein the apparatus is a through-tubing tool for passing through tubing having a smaller cross section area than the cross section area of the wellbore at the injection location and wherein the seal elements are radially compressible sufficient to pass through the smaller tubing.

6. The injection apparatus of claim 1 wherein the sleeve is of a size to pass through the smaller tubing.

7. The injection apparatus of claim 1 additionally comprising an annular valve seat in the passageway and an additional port extending through the valve seat.

8. The injection apparatus of claim 7 wherein the valve seat comprises a ball valve seat.

9. The injection apparatus of claim 1 wherein the actuator assembly comprises a fluid actuated apparatus on the body coupled to the sleeve; the fluid actuated apparatus when actuated moves the sleeve from around the compressed seal elements allowing the seal elements to expand.

10. The injection apparatus of claim 9, wherein the actuator assembly comprises:

(a) a variable volume chamber inside the sleeve around the body bordered on one end by an end cap and the other end by a piston, wherein the end cap is connected to the end of the sleeve and surrounds and axially slides along the outside of the body;

(b) an annular packing that seals an annulus formed between the end cap and the body, wherein the piston is fixed on the outside of the body, and the packing seals the annulus between the piston and the interior of the sleeve; and (c) a connecting port that connects the variable volume chamber and the interior passageway of the body.

11. The injection apparatus of claim 1 wherein the body comprises a mandrel.

12. The injection apparatus of claim 11, wherein the seal elements are adapted to contact the interior wall of the wellbore at the injection location and have sufficient length to prevent fluid flow through the annulus.

13. The injection apparatus of claim 11 additionally comprising a valve in the passageway.

14. The injection apparatus of claim 13 wherein the valve comprises an annular valve seat.

15. The injection apparatus of claim 14 wherein the valve seat comprises a ball valve seat.

16. The injection apparatus of claim 13 additionally comprising an additional port extending through the valve.

17. An apparatus for use in injecting fluid at a subterranean wellbore location, the apparatus comprising:

(a) a body having an interior passageway connected to an injection port in the body, wherein the body comprises a mandrel and having a valve in the passageway;

(b) upper and lower annular seal elements mounted on the body, wherein:

(i) the seal elements are radially compressible, (ii) the seal elements being of a size to engage the walls of the wellbore at the injection location and wherein the seal elements are made at least in part from foamed material and are adapted for containing fluid in an annular space between the upper and lower seal elements; and (iii) the injection port is located between the seal elements;

(c) a sleeve surrounding and compressing the seal elements; and (d) an actuator assembly for removing the sleeve from around the seal elements when the apparatus reaches the injection location wherein the actuator assembly comprises: a fluid actuated apparatus on the body coupled to the sleeve; the fluid actuated apparatus when actuated moves the sleeve from around the compressed seal elements allowing the seal elements to expand.

18. The injection apparatus of claim 17, wherein the actuator assembly comprises:

(a) a variable volume chamber inside the sleeve around the body bordered on one end by an end cap and the other end by a piston, wherein the end cap is connected to the end of the sleeve and surrounds and axially slides along the outside of the body;

(b) an annular packing that seals an annulus formed between the end cap and the body, wherein the piston is fixed on the outside of the body, and the packing seals the annulus between the piston and the interior of the sleeve; and (c) a connecting port that connects the variable volume chamber and the interior passageway of the body.

19. An apparatus for use in injecting fluid at a subterranean wellbore location, the apparatus comprising:

(a) a body having an interior passageway connected to an injection port in the body;

(b) upper and lower annular seal elements mounted on the body, wherein:

(i) the seal elements are radially compressible, (ii) the seal elements being of a size to engage the walls of the wellbore at the injection location and wherein the seal elements are made at least in part from foamed material and are adapted for containing fluid in an annular space between the upper and lower seal elements; and (iii) the injection port is located between the seal elements;

(c) a sleeve surrounding and compressing the seal elements; and (d) an actuator assembly for removing the sleeve from around the seal elements when the apparatus reaches the injection location, wherein the actuator assembly comprises a fluid actuated apparatus on the body coupled to the sleeve; the fluid actuated apparatus when actuated moves the sleeve from around the compressed seal elements allowing the seal elements to expand.

20. The injection apparatus of claim 19, wherein the actuator assembly comprises:

(a) a variable volume chamber inside the sleeve around the body bordered on one end by an end cap and the other end by a piston, wherein the end cap is connected to the end of the sleeve and surrounds and axially slides along the outside of the body;

(b) an annular packing that seals an annulus formed between the end cap and the body, wherein the piston is fixed on the outside of the body, and the packing seals the annulus between the piston and the interior of the sleeve; and (c) a connecting port that connects the variable volume chamber and the interior passageway of the body.

21. An apparatus for use in injecting fluid at a subterranean wellbore location, the apparatus comprising:

(a) a body having an interior passageway connected to an injection port in the body;

(b) radially compressible annular seal elements carried on the body on opposite sides of the injection port, the seal elements being of a size to engage the walls of the wellbore at the injection location and wherein the seal elements are made at least in part from foamed material; and (c) a sleeve surrounding and compressing the seal elements, wherein the sleeve is adapted for axially moving from around the seal elements when the apparatus reaches the injection location.

22. The apparatus according to claim 21, wherein the seal elements are adapted for containing fluid in an annular space between the seal elements.

* * * * *